United States Patent [19]

Schuermann

[11] Patent Number: 5,039,252

[45] Date of Patent: Aug. 13, 1991

[54] CABLE FEED ASSEMBLY FOR USE WITH A VIBRATORY PLOW

[75] Inventor: Kenneth W. Schuermann, Perry, Okla.

[73] Assignee: The Charles Machine Works, Inc., Perry, Okla.

[21] Appl. No.: 411,106

[22] Filed: Sep. 22, 1989

[51] Int. Cl.[5] ..... A01B 3/64; F16L 1/00; E02F 5/10

[52] U.S. Cl. ..... 405/182; 405/177; 405/180

[58] Field of Search ..... 405/154, 174, 177, 180, 405/182, 183; 226/152, 156, 157; 254/29 R, 134.3 FT

[56] References Cited

U.S. PATENT DOCUMENTS

| | | | |
|---|---|---|---|
| 2,722,181 | 11/1955 | Hash . | |
| 2,900,931 | 8/1959 | Lisle | 405/183 |
| 2,904,167 | 9/1959 | Guess . | |
| 2,912,100 | 11/1959 | Logan . | |
| 3,066,491 | 12/1962 | Ryan . | |
| 3,363,423 | 1/1968 | Davis . | |
| 3,405,533 | 10/1968 | Fries . | |
| 3,713,300 | 1/1973 | Ward . | |
| 3,788,575 | 1/1974 | Boettcher et al. . | |
| 3,935,712 | 2/1976 | Erickson et al. | 405/182 |
| 4,397,585 | 8/1983 | Fouss et al. | 405/183 |

OTHER PUBLICATIONS

The Plow People–Ditch Witch–The Charles Machine Works, Inc.

*Primary Examiner*—Dennis L. Taylor
*Assistant Examiner*—John A. Ricci
*Attorney, Agent, or Firm*—Laney, Dougherty, Hessin and Beavers

[57] ABSTRACT

A cable feed subassembly for use with a vibratory plow in placing a cable or tube in the earth. The plow includes a plow blade and an associated vibratory unit. A cable guide assembly is mounted on the rear side of the plow blade and an incremental cable feed subassembly is mounted in association with the vibratory unit so as to be oscillated in synchronism with the vibratory cycles of the vibratory unit. The cable feed subassembly includes a pair of cooperating rollers through which the cable is passed, and by which it is forced downwardly by the periodic, incremental rotation of at least one of the rollers.

21 Claims, 2 Drawing Sheets

CABLE FEED ASSEMBLY FOR USE WITH A VIBRATORY PLOW

Field of the Invention

This invention relates to cable burying plows in which a plow blade is advanced to develop a trench into which a cable is continuously fed.

BACKGROUND OF THE INVENTION

Brief Description of the Prior Art

A number of machines have previously been provided which can be utilized to make a trench or furrow in the earth, and concurrently lay within that trench a cable, flexible pipe or the like. Generally these devices utilize a self-propelled vehicle, such as a tractor, and provide a plow or blade which is pulled through the earth by the tractor to open the trench which is to receive a cable or flexible pipe. The cable or pipe is fed into the trench through a suitable guide mechanism, frequently from a reel mounted at an elevated location on the apparatus. In some systems, this feeding of the cable or flexible pipe is accomplished manually, and in some instances, it is fed off of the reel or source of supply by a powered constant speed feed motor.

It is known to provide, as an aid to the trench or furrowforming part of the cable burying operation, a vibration developing structure by which an oscillating up-and-down motion is periodically developed. The cyclically occurring up-and-down forces thus periodically developed are transmitted through intervening structure to the plow blade. This enhances the progression of the plow blade through the soil in that it imparts a periodic impact force component to the plow which aids its advance.

In some other types of vibratory plows, periodically acting opposed force vectors are developed which act in directions other than up-and-down.

In U.S. Pat. No. 3,405,533 issued on Oct. 15, 1968 to Fries, two cable burying plow structures of the type described are illustrated. In one of these, a vibrating frame is provided and is attached to a tractor or other pulling vehicle. A plow shank 30 is mounted on the vibrating frame so that the oscillatory and periodic vibrations are imparted to the shank. The plow shank 30 is provided with connecting structures enabling it to support a cable guide carried behind the plow shank, and functioning to guide a cable over a series of sheaves or pulleys to a substantially horizontal path aligned with the lower edge of the plow blade and shank so that the cable is laid in the trench or furrow formed by the vibrating plow blade as it is pulled through the earth by the tractor.

A second form of the cable laying assembly is also shown in this patent. In this apparatus, the cable is fed principally through an elongated tube which extends transversely across the shank of the plow and into a position of horizontal alignment with the point of the plow so as to discharge the cable guided through the tube into a trench or furrow formed by the plow.

A cable laying system is depicted and described in U.S. Pat. No. 3,788,575. In that system, the large reel upon which the cable is stored, and from which it is paid out as it is placed in a trench by the apparatus, is positively driven by a hydraulic motor. This assures that the anchoring tension developed in the cable as it is placed in the trench and then covered does not part the cable due to inertial forces in the reel. The hydraulic motor is responsive to the tension in the cable to speed up or slow down the reel as may be needed.

The apparatus by which the cable is placed in a trench in U.S. Pat. No. 3,788,575 includes an elongated tubular element functioning as a cable guide, and carried behind an elongated, point-carrying conventional trencher which forms the narrow trench into which the cable is deposited. This entire assembly is carried on the back of a cable laying framework which is mounted on road wheels, and is adapted to be towed in a conventional manner behind a traction unit. U.S. Pat. No. 3,788,575 also points out how, in some instances prior to the time of the patent, cables had been manually paid out from the reel as the demands of the span of cable deposited in the trench required. This patent also points out that in some prior art forms of cable laying devices, the cable had been positively driven through the cable guide for deposition in the trench by frictional drive elements which positively engaged the cable itself.

One method of frictionally advancing a cable or tubular element in incremental movements is disclosed in U.S. Pat. No. 2,912,100. In this patent, a quick acting drive mechanism is provided which acts through an eccentric cam drive to periodically drive a rack which engages a gear wheel forming a part of a pawl and ratchet arrangement. The gear wheel is keyed to a drive roller acting as one of two rollers through which a cable is passed. At periodic intervals, the drive roller is rotated through an increment of rotation to effectively drive the cable in a corresponding increment of advance.

Another apparatus by which a cable or wire can be incrementally advanced in selected intervals during rotation of a cable-engaging pair of rollers is disclosed in U.S. Pat. No. 2,904,167. In this system, a drive motor acts as a linkage to periodically cause arms carrying dogs to oscillate so as to engage a ratchet wheel having selectively spaced teeth thereon. The ratchet wheel thus is caused to also undergo an intermittent angular advance as the teeth are engaged and released by the dog carried on the oscillating linkage. The ratchet wheel in turn drives a drive roller which is one of a pair of rollers through which the cable is extended, and by which it is frictionally engaged. Slippage of the rollers on the cable can be eliminated, or it may be allowed to occur in a controlled measure as the rollers drive the cable.

Yet another cable or conduit placing machine is shown in Hash U.S. Pat. No. 2,722,181.

An interesting arrangement for driving the cable through a cable guide tube to a location in the bottom of the trench is illustrated in Ryan U.S. Pat. No. 3,066,491. In the Ryan patent, a hand guided cable or wire laying apparatus is depicted. This apparatus basically includes a frame pulled behind a powered vehicle, and supported on ground-engaging wheels. The axle which interconnects the ground-engaging wheels carries a sprocket which drives a chain extending rearwardly along the frame until it comes to a location over the cable guide tube where the cable is passed into the upper end of the cable guide tube. At this location, the sprocket driven chain continuously drives a pair of force feed rollers which engage the cable, and force it into the upper end of the cable guide tube. The drive is continuous, of course, rather than intermittent, and the rate of feed is controlled by the rate at which the powered chain is driven by the ground-engaging wheels. Adjusting means is provided to adjust the amount of clearance between the force feed rollers which engage opposite sides of the cable for driving it downwardly through the cable tube. Thus, the size of cable so driven can be varied, as well as degree of slippage of the rollers against the cable.

In Davis U.S. Pat. No. 3,363,423, an underground cable laying implement is illustrated and described. In the Davis machine, the trench slitting blade generally characteristic of this type of apparatus is provided, and is trailed by a cable guide tube through which the cable is fed into the trench formed by the blade. The guide tube is made to float, or to be pivotable on the blade, so that a reciprocating motion imparted to the blade by a blade reciprocating mechanism is not transferred to the cable guide tube.

The blade reciprocating mechanism employed includes a housing mounted on the blade-carrying frame, and within this housing, a pair of counterrotating wheels or gears is supported. These wheels rotate in opposite directions, and carry a pair of corresponding eccentric weights located near the outer periphery of the gears, and rotated with them in counterrotative directions. The synchronization of movement and location of the eccentric weights is such that additive upward components of force, and additive downward components of force are periodically developed as the gears or wheels are counterrotated and the eccentric weights act in an additive fashion to produce the upward components and downward components of force. This causes the blade to reciprocate up and down. Concurrently, of course, it is being pulled forward by the vehicle upon which the cable laying implement is mounted.

In U.S. Pat. No. 3,713,300, a manually guided cable laying device includes front and rear traction wheels which are located on the opposite sides of a vertical line in which the digger blade is located. The digger blade is caused to undergo both a forward movement and an oscillatory motion which causes it to move through an eliptical path. The digger blade, by reason of this motion, meters or pulls cable through a cable guide disposed between the pair of traction wheels.

Another type of vibratory cable laying plow which is currently marketed is a cable laying vibratory plow manufactured by The Charles Machine Works of Perry, Okla. This company makes several types of vibratory cable laying plows, but one, referred to as a VP75, uses counterrotating, eccentric weight-carrying discs or plates to impart a vibratory motion to the plow blade as it is pulled through the earth. A pair of gauge skids set the depth at which the plow blade will penetrate into the earth. A cable feed tube is secured to the rear side of the plow blade, and functions to feed a cable into the narrow trench formed by the vibrating plow.

BRIEF DESCRIPTION OF THE INVENTION

The present invention is directed to an improvement in cable laying vibratory plows which, by reason of such improvement, develop a positive feed for cable entering a cable guide or channel, and thus assure a more even and positive pay out of the cable into the trench developed by an oscillating trench forming plow blade.

Broadly described, the cable burying vibratory plow structure of the present invention includes a frame which has a pair of vertically spaced, rearwardly extending elongated beams or arms which can be pivotally attached to a powered towing vehicle. Means is provided for raising and lowering these arms so as to lower the plow and cable guide carried at the rear of the arms.

The cable laying vibratory plow further includes, in conventional fashion, a vertically extending plow blade or shank carried at the rear of the frame and having a plow point at the lower and forward side thereof. Mounted on the rear or trailing side of the plow shank is a cable guide or cable directing channel. A ground-engaging pressure foot or skid or slide is a floating support pivotally mounted at the rear of the lower arm of the frame, and functions as a depth gauge device to control the depth to which the plow blade shank will form the trench in the earth.

Carried upon the frame between its upper and lower arms at a location relatively near to the top of the plow blade is an oscillatory motion developing assembly. The oscillatory motion developing assembly is power driven by a suitable motor which drives counterrotating gears or discs of a conventional type carrying eccentric weights at the outer periphery thereof. A typical structure of this type is shown in FIG. 7 of the drawings of this application, and includes a pair of counterrotating disks which carry eccentric weights and mounted in a suitable housing and driven in rotation, all as described in Davis U.S. Pat. No. 3,363,423. The counterrotating discs function cooperatively to alternately develop a net upward, then a net downward force, during their rotation. The plow blade is thus caused to reciprocate upwardly and downwardly at the same time that it is being pulled through the earth by the towing vehicle.

The improvement of the invention includes an incremental cable feeding subassembly. The incremental cable feeding subassembly comprises a housing which is mounted upon a part of the oscillating motion developing assembly. Therefore, along with the plow blade, the lower arm and the upper arm, the housing of the incremental cable feeding subassembly also undergoes an oscillatory up-and-down movement.

The housing of the incremental cable feeding subassembly contains a pair of cable engaging rollers which bear against opposite sides of the cable which is to be fed through the upper end of the cable guide. One of these rollers is connected through a clutch and shaft to one end of a cantilevered arm which carries a weight at its free outer end. The cantilevered arm and its associated weight respond to the periodic oscillatory force developed by the oscillatory motion developing assembly, and this arm periodically oscillates up-and-down on opposite sides of a central reference axis about a pivotal axis which coincides with the axis of the shaft upon which both the drive roller and one end of the cantilevered arm are mounted.

The roller supported on the shaft which carries the cantilevered shaft is a drive roller, because the oscillating movement of this arm is transmitted through the central shaft of this roller, and through an overrunning clutch structure to the roller. The clutching action causes the roller to undergo periodic incremental rotative movements. In other words, as the cantilevered arm oscillates in synchronous response to the oscillatory movements imparted to the plow blade by the counterrotating eccentric weights in the oscillating motion developing assembly, the arm, acting through the overrunning clutch, causes the drive roller to be periodically incrementally rotated in a cable advancing direction.

Cooperating with the powered drive roller is a second roller, also termed a holding roller, which frictionally engages the opposite side of the cable. This roller also surrounds an overrunning clutch which mounts it upon a suitable shaft.

Through the cooperative action of the rollers, a downward force is applied as a periodically acting friction drive, driving the cable into the cable guide, and into the trench formed in the earth.

An important object of the present invention is to provide a positive drive for a cable being fed through a cable guide structure into a trench being continuously formed and advanced through the earth, with the powered assist to the cable helping to assure a positive, relatively even feed and the development of the necessary controlled advance of the cable, without the requirement for manual feeding to the cable guide.

A further object of the invention is to take advantage of the existence upon some types of cable burying plows of a mechanism for developing a periodically acting oscillatory force which is imparted to the plow blade so as to use this force to develop a periodically acting frictional drive by which the cable can be incrementally fed with a positive driving force into a cable guide structure which delivers the cable to the bottom of a trench being continuously formed.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
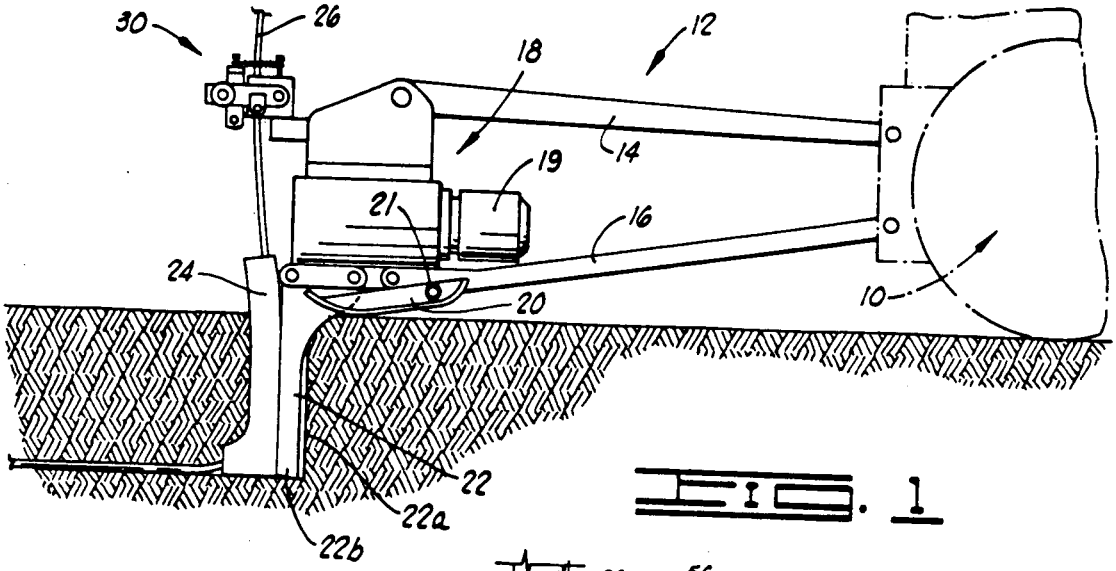
FIG. 1 is a side elevation view of the cable burying vibratory plow of the invention.

In FIG. 1 of the drawings, a towing powered vehicle is shown in dashed lines and designated generally by reference numeral 10. The cable burying vibratory plow of the invention is shown coupled to the vehicle 10 to permit the trench or furrow forming plow blade to be drawn through the earth at a predetermined depth.

The vibratory plow apparatus is mounted upon a frame 12 which has rearwardly extending support arms, including an upper arm 14 and a lower arm 16. Each of these arms is pivotally connected at its forward end to the vehicle 10. The lower arm 16 supports a power driven oscillatory mechanism, indicated generally by reference numeral 18. The power driven oscillatory mechanism 18 is driven by a suitable hydraulic motor 19, and it functions to develop oscillating, or periodic forces which act alternately upwardly and downwardly, imparting reciprocating motion to the plow shank and point as hereinafter described.

Figure 7:
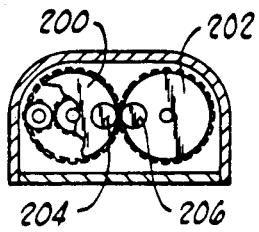
FIG. 7 is a view in elevation, with parts broken away, showing a counterrotating disk with weights attached as used to impart vibration to a vibratory plow.

The oscillatory mechanism may, for example, be of a type which causes a periodic movement of the supporting structure in a generally upwardly and downwardly direction, such as the structure illustrated in FIG. 7. This structure, which is shown in Davis U.S. Pat. No. 3,363,423, includes a pair of counterrotating discs 200 and 202 which carry eccentric weights 204 and 206, and which are mounted in a suitable housing as shown.

A ground pressure foot or skid 20 is pivotally secured to the underside of the lower arm 16 adjacent its rear end, and the transverse shaft 21 upon which the skid is mounted is spring loaded torsionally so that the spring functions to absorb a part of the oscillatory motion of the arm 16 in an upwardly and downwardly direction as caused by the power driven oscillatory mechanism 18. The upper end of the power driven oscillatory mechanism 18 is pivotally connected to the upper arm 14. Thus, the up-and-down oscillatory motion, and alternating upward and downward forces developed by the power driven oscillatory mechanism 18, are transmitted to the upper arm 14 and lower arm 16 during the operation of the cable burying vibratory plow as hereinafter described.

Secured to the power driven oscillatory mechanism 18 and extending downwardly therefrom, is an elongated plow shank 22. The plow shank 22 has a sharpened leading edge **22*a* and carries a plow share or point 22*b*** at its lower, forward end.

A cable guide element or tubing 24 is secured to the rear side of the plow shank 22. The cable guide element 24 can be any of the various types now known in the art, and may include one or more sheaves or guide rollers located internally for guiding a cable or tubing or the like through the cable guide to a location adjacent the bottom of the plow shank 22 where the trench is being formed. As is understood in the art, the cable 26 is fed into the open upper end of the cable guide 24, and is passed out of the lower end of the cable guide in a horizontal direction so that it lays along the bottom of the trench formed by the plow shank 22 and the sharpened leading edge or point **22*a*** carried thereon.

An incremental cable feeding subassembly, designated generally by reference numeral 30, is secured to the power driven oscillatory mechanism 18 as illustrated in FIG. 1. The incremental cable feeding subassembly 30 engages the cable 26 between a pair of cooperating rollers in a manner and for the purpose hereinafter described. The incremental cable feeding subassembly 30 is illustrated in detail in FIGS. 2-6 of the drawings. The cable feeding subassembly 30, as there illustrated, and in a preferred embodiment of the invention, includes a substantially rectangular mounting plate 32 which is secured to the power driven oscillatory mechanism 18, and projects outwardly from the rear end thereof. The mounting plate 32 has a U-shaped recess 33 extending in from one side thereof to allow passage of the cable 26. The mounting plate 32 has a downwardly curved outer rear end **32*a* which is secured to a bearing sleeve 34**.

The bearing sleeve 34 rotatably journals an axle or shaft 36 which is secured at its opposite ends to a pair of upwardly extending roller support plates 38 and 40. At the upper ends of the roller support plates 38 and 40, these plates are connected by a transversely extending tie plate 42. At its end over the roller support plate 38, the transversely extending tie plate 42 has a spring post 43 secured to the upper side thereof. Intermediate the length of each of the vertically extending roller support plates 38 and 40, a feed roller or sheave 44 is supported by an overrunning clutch 46 which surrounds a transversely extending shaft 48 which has its opposite ends secured to, and movable with, the upwardly extending roller support plates 38 and 40.

The roller 44 is preferably constructed of rubber or other elastomeric material of sufficient bulk and mass, and having a selected Shore hardness, such that it can yield and distort as may be needed if for any reason the cable cannot be advanced.

From the description of the incremental cable feeding subassembly thus far, it will be perceived that the support plates 38 and 40, which rotatably support the roller 44, can rock or pivot about the axis of the axle or shaft 36, as this shaft pivots within the surrounding sleeve 34. Thus, the position of the roller 44 can be bodily rocked toward the right or toward the left as that roller is viewed in FIG. 2. Stated differently, the holding roller 44 can be made to move closer to, or further away from, the cable 26 as that cable is viewed in FIGS. 2 and 3. As will be seen, this enables the size of cable passed through the incremental cable feeding subassembly 30 to be varied, and it also enables the operator of the apparatus to adjust the force with which the cable is gripped between these pairs of rollers in the incremental cable feeding subassembly.

Spaced from the pair of upwardly extending idler roller support plates 38 and 40 are a pair of substantially parallel, upwardly extending, fixed, drive roller support plates 50 and 52. Each of the drive roller support plates 50 and 52 is secured by welding, or other suitable means, to the mounting plate 32 along the side edges of the mounting plate, and project substantially normal to the plane thereof in an upwardly extending direction. The roller mounting plate 50 has a spring post 54 projecting upwardly from its upper end, and a suitable spring 56 is placed in tension between the spring post 54 and the spring post 43 to which the opposite end of the spring is connected. It will be perceived that the function of the spring 56 is to resiliently bias the bracket formed by the transversely extending plate 42 (which carries the spring post 43) and the two upwardly extending roller support plates 38 and 40 in the direction of the cable 26 so as to more tightly engage the cable.

At a location intermediate the height of the support plates 50 and 52, the support plates receive in suitable bearing sleeves or journals, 53 and 55, the opposite ends of a shaft 62. The shaft 62 then extends through a centrally located tubular or sleeve-like overrunning clutch, designated generally by reference numeral 64. The overrunning clutch 64 is positioned between the shaft 62 and a drive roller 66. The drive roller 66 and roller 44 are pulled into frictional engagement with the sides of the cable 26 by the action of the spring 56. Each of the overrunning clutches 46 and 64 includes a plurality of sprags which surround the respective shafts 48 and 62 and each acts as a pawl and ratchet. Thus, the clutch 64 engages the drive roller 66 to the shaft 62 when the shaft rotates in a counterclockwise direction, as it is viewed in FIG. 2, and disengages the shaft 62 from the drive roller 66 at a time when the shaft is rotated in a counterclockwise direction.

Like the holding roller 44, the drive roller 66 is preferably constructed of a rubber or suitable elastomeric material having a bulk and Shore hardness such that the rubber can undergo an adequate amount of shape distortion to allow the stroke of the cantilevered arm, hereinafter described, to be accommodated at a time when the cable is fouled or unable to advance.

Figure 2:
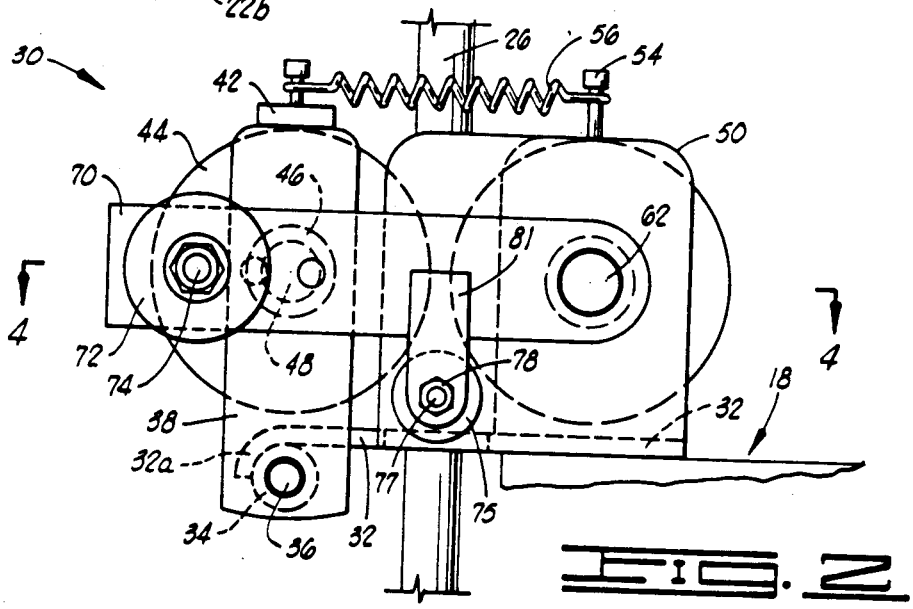
FIG. 2 is a view in side elevation of an incremental cable feed subassembly forming a principal part of the present invention.
Figure 3:
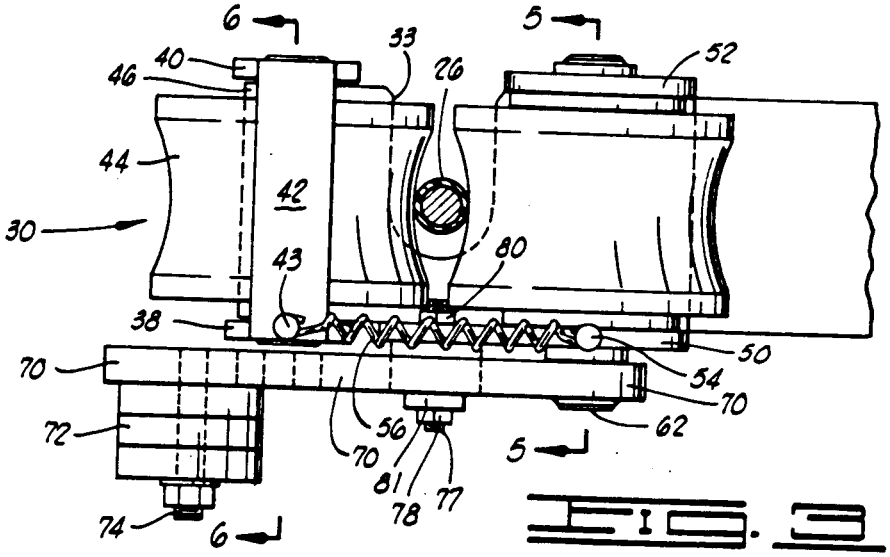
FIG. 3 is a plan view of the incremental cable feed subassembly depicted in FIG. 2, and showing, in section, a cable passing therethrough.
Figure 4:
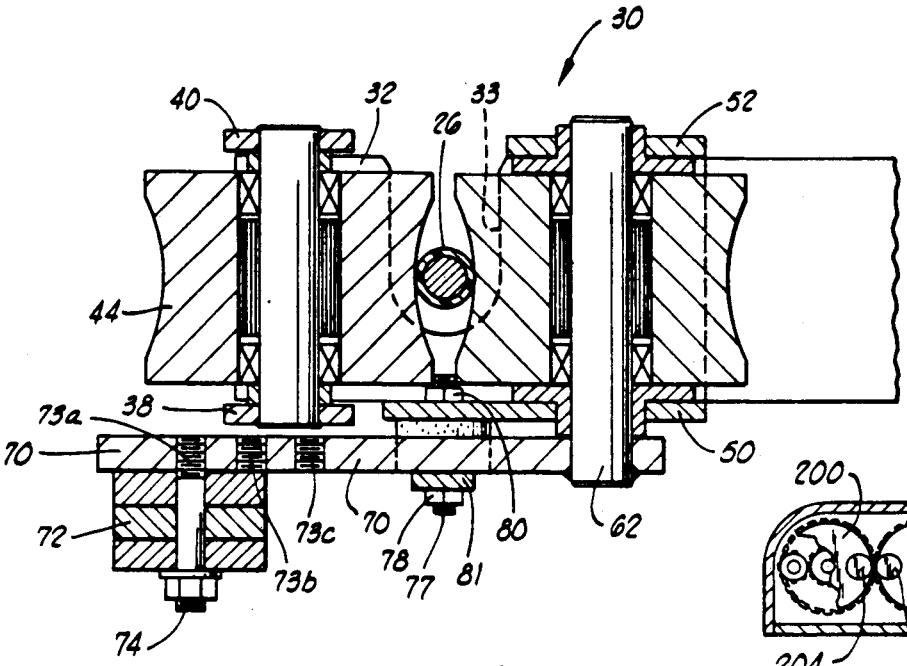
FIG. 4 is a sectional view taken along line 4—4 of FIG. 2.

A cantilevered oscillating arm 70 has one of its ends secured to the outer end of the shaft 62, and is spaced outwardly from the drive roller support plate 50, as shown in FIG. 3. The cantilevered oscillating arm 70 carries a weight 72 at its end opposite the end which is secured to the drive shaft 62. The weight 72 can be secured to the arm 70 by a suitable bolt or pin 74 or other suitable means. It will be noted in referring to FIGS. 2 and 3 that the weight 72 can be shifted to any one of three locations by simply threading the pin or bolt 74 upon which the weight is carried into a selected one of three holes 73*a*, 73*b* and 73*c* which are axially spaced from each other along the arm 70. The reason for shifting the weight 72 will become apparent as the operation of the cable feeding subassembly is subsequently explained. Other methods for shifting the weight 72 can also be utilized.

Figure 5:
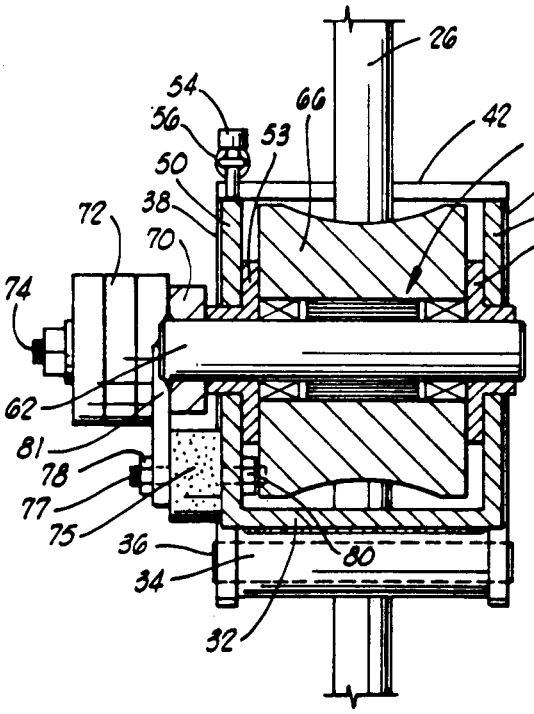
FIG. 5 is a sectional view taken along line 5—5 of FIG. 3.
Figure 6:
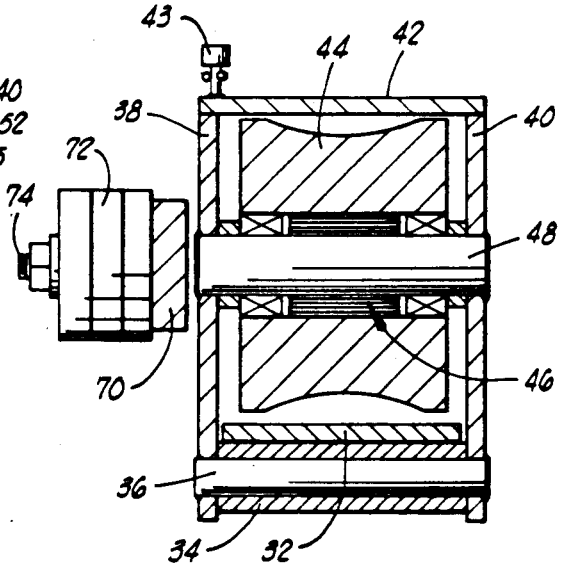
FIG. 6 is a sectional view taken along line 6—6 of FIG. 3.

A resilient disc 75 of rubber, or other resilient material, is provided for horizontally positioning the cantilevered oscillating arm 70. In this respect, it supplies a restoring force for orienting the arm 70 in a centered position. The resilient disc 75 is mounted on the fixed driver roller support plate 50 by means of a bolt 79 which is threaded on its end, and is secured to this plate by suitable nuts 78 and 80. The guide plate 81 has an upper end secured to the oscillating arm 70 as shown in FIG. 5, and projects downwardly as shown in FIGS. 2 and 5. Its lower end is positioned at one side or end face of the disc 75 to which it is secured by bolt 77 and nut 78.

OPERATION

In the operation of the cable burying vibratory plow of the invention, the frame 12, which includes the upper and lower arms 14 and 16, is pivotally connected to the rear end of a powered towing vehicle and to a suitable hydraulic lifting cylinder carried thereon (not shown) so that both arms can be moved upwardly and downwardly as may be needed. At the rear end of the frame 12, the power driven oscillatory mechanism 18 is driven in rotation by the hydraulic motor 19 to develop an up-and-down reciprocating motion of the plow shank 22.

As the powered towing vehicle 10 moves forwardly, and the plow shank 22 moves down in the ground, the depth can be controlled by the ground pressure foot 20. The cable 26 (or tubing) to be placed in the trench to be developed by the plow is fed downwardly within the cable guide 24 to a location which is near the lower end thereof. The cable 26 can be positively fed to that location through the use of the incremental cable feeding subassembly 30. In most instances the rubber material of which the rollers 44 and 66 are constructed has a Shore hardness which is selected so that the body of rubber will simply distort as needed to accommodate the oscillatory advancing stroke of the arm 70 without dragging against, and abrading, the slowed or arrested cable. Arresting of the cable may occur either through braking of the drum or reel from which it is being paid, or by stopping the forward motion of the plow without disengaging or stopping the oscillating mechanism. In either case, it is not possible to continue the incrementally advancing movement of the cable.

After the plow shank 22 has reached the depth to which it is desired to form a trench, as controlled by the ground pressure foot or skid 20, the plow shank and sharpened leading edge continue to be reciprocated upwardly and downwardly in a vibratory motion. This vibratory movement is imparted to the plow by the powered oscillatory motion generating mechanism 18.

As the vibratory motion is imparted to the arms 14 and 16 by the powered oscillatory motion generating mechanism 18, the incremental cable feeding subassembly 30 also undergoes a reciprocating up-and-down movement as it rides up and down on the mechanism 18. As the mounting plate 32 which is secured to the oscillatory motion generating mechanism moves upwardly and downwardly, this causes the cantilevered oscillating arm 70 carrying the weight 72 to inertially respond to this up-and-down movement. The cantilevered arm 70 undergoes its own oscillating movement in which it pivots upwardly and downwardly about a pivotal axis which extends coaxially with the axis of the drive shaft 62. The drive shaft 62 is, as previously explained, secured to one end of the oscillating arm 70. As the drive shaft 62 is partially rotated in first one direction, and then the other, the overrunning clutch 64 positioned between the drive shaft and the drive roller 66 causes the roller to be periodically advanced incrementally in one direction which, as viewed in FIG. 2 of the drawings, is the counterclockwise direction.

Assuming that the drive roller 66 and the holding roller 44 have been drawn tightly against the opposite sides of the cable 26 by the spring 56, so as to drivingly engage the cable, this incremental angular motion of the drive roller will, in cooperation with the one-way rotative holding roller 44, advance the cable incrementally downwardly into the cable guide 24. The roller 44, like the drive roller 66, coacts with its respective clutch 46, so as to be periodically advanced incrementally in one direction of rotation, and prevented from counter-rotating in the opposite direction. It thus functions to hold the cable against any pulling out movement. Thus, the cable 26 is incrementally paid out of the cable guide 24 into the trench by a positive feeding force which acts periodically upon the cable, and assures that it has a positively acting force applied to it. Reverse movement of the cable is prevented by the inability of either the drive roller 66 or the holding roller 44 to rotate in a direction opposite the feeding direction. This is a very desirable means of feeding the cable efficiently and safely, without imparting sudden strains on the cable. If necessary, the cable can be pulled freely through the rollers 44 and 66 in the feed direction. Examples of occasions when such free pulling through the rollers is necessary are (a) when initially threading the cable into the plow blade feed tube, and (b) when pulling a "slack loop" of cable along the installation path to accommodate a splicing terminal or branch lines.

As has been previously pointed out, variously sized cables 26 or, in the alternative, various types of tubing or flexible pipe, can be fed through the incremental cable feeding subassembly 30 without difficulty. Moreover, the amplitude of the oscillatory strokes of the cantilevered oscillating arm 70 can be adjusted as may be desired in terms of the extent of each increment of cable feed by shifting, as may be needed, the weight 72 along the length of the cantilevered arm 70, using the several holes in the arm, or other suitable means, to effect this adjustment.

Although a preferred embodiment of the present invention has been herein described, it will be understood that various changes and innovations in the illustrated and described structure can be effected without departure from the basic principles which underlie the invention. Changes and innovations of this type are therefore deemed to be circumscribed by the spirit and scope of the invention, as defined by the appended claims, when the same are given a reasonably broad range of equivalents in the course of their interpretation.

What is claimed is:

1. A cable feeding apparatus for burying a cable, flexible tube or the like in a trench comprising:

a vibrating plow having a plow blade with a lower side and a leading point;

a cable guide mounted adjacent the plow for guiding a cable or the like downwardly to a location substantially aligned with the lower side of the plow blade, and a trench formed by the plow blade;

oscillating motion developing means connected to said vibrating plow blade for developing an up-and-down vibratory reciprocating motion in said plow blade;

an incremental cable feeding subassembly adapted to frictionally engage the cable, and connected to, and responsive to, said oscillating motion developing means for incrementally feeding said cable into said cable guide in synchronism with the vibratory motion of said plow blade, said incremental cable feeding subassembly comprising:

at least one feed roller mounted for rotation at a location adjacent the path of movement of said cable, with the periphery of said feed roller positioned to frictionally engage the side of the cable to advance the cable as said one roller is driven in rotational movement in one direction; and means for periodically driving said one roller through an increment of rotation in said one direction when said cable is to be positively fed into said cable guide, then releasing said periodically driven roller to a status in which the released roller is free to rotate in one direction of rotation; and frame means interconnecting said vibrating plow blade, said oscillating motion developing means and said incremental cable feeding subassembly.

2. An apparatus as defined in claim 1 wherein said oscillating motion developing means comprises:

a pair of counterrotating discs mounted for rotation in opposite directions about parallel rotational, substantially horizontal axes; and weights mounted on each of said disc eccentrically with respect to the respective rotational axes thereof and positioned so that when said discs are rotated at the same speed, the eccentrically mounted weights develop cancellative, oppositely acting forces in a horizontal direction, and additive forces in an upward direction and in a downward direction during each rotation of the discs.

3. An apparatus as defined in claim 1 wherein said oscillating motion developing means comprises:

a pair of counterrotating discs mounted for rotation in opposite directions about parallel rotational, substantially horizontal axes; and weights mounted on each of said discs eccentrically with respect to the respective rotational axes thereof and positioned so that when said discs are rotated at the same speed, the eccentrically mounted weights develop cancellative, oppositely acting forces in a horizontal direction, and additive forces in an upward direction and in a downward direction during each rotation of the discs.

4. An apparatus as defined in claim 1 wherein said cable feeding subassembly further includes means for adjusting the pair of feed rollers toward and away from each other to accommodate cables of varying size extended therebetween.

5. An apparatus as defined in claim 4 wherein said adjusting means is a part of said means for rotatably supporting said rollers and comprises:

a mounting plate secured to said oscillating motion developing means; and a pair of upwardly extending, substantially parallel roller support plates pivotally connected to said mounting plate for pivotation about an adjustment axis extending parallel to said parallel rotational axes of said rollers;

a shaft extending between said pivotally connected roller support plates, and supporting the other of said rollers; and means resiliently urging said one roller and said other roller toward each other by pivotation of said support plates and the other roller carried thereby about said adjustment axis.

6. An apparatus for burying a cable, flexible tube or the like in a trench comprising:

a vibrating plow having a plow blade with a lower side and a leading point;

a cable guide mounted adjacent the plow blade for guiding a cable or the like downwardly to a location substantially aligned with the lower side of the plow blade, and into a trench formed by the plow blade;

oscillating motion developing means connected to said vibrating plow blade for developing an up-and-down vibratory reciprocating motion in said plow blade;

an incremental cable feeding subassembly connected to, and responsive to, said oscillating motion developing means for incrementally feeding said cable into said cable guide in synchronism with the vibratory reciprocating motion of said plow, said incremental cable feeding subassembly comprising:

a pair of feed rollers mounted for rotation about parallel axes with the peripheries of said feed rollers spaced to engage the opposite sides of the cable to advance the cable as one of the rollers is driven in rotative movement;

means rotatably supporting said rollers for rotation about said parallel axes, said supporting means comprising:

a rotatable driven shaft extending axially through one of said rollers; and an overrunning clutch positioned between said driven shaft and said one roller for angularly advancing said one roller when said driven shaft is rotated in one direction of rotation, and for disengaging said shaft from said one roller when said shaft is rotated in the opposite direction; and an elongated oscillating arm connected to, and cantilevered from, said rotatable, driven shaft; and a weight on said oscillating arm, said oscillating arm and said weight being inertially responsive to the up-and-down vibratory motion developed by said oscillating motion developing means to oscillate up and down from a neutral position about the axis of said rotatable driven shaft to cause said driven shaft to rotate periodically incrementally in one direction, and then alternately, periodically incrementally in the opposite direction;

frame means interconnecting said vibrating plow, said oscillating motion development means and said incremental cable feeding assembly.

7. An apparatus as defined in claim 6 wherein said cable feeding subassembly further includes means for adjusting the pair of feed rollers toward and away from each other to accommodate cables of varying size extended therebetween.

8. An apparatus as defined in claim 7 wherein said adjusting means is a part of said means for rotatably supporting said rollers and comprises:

a mounting plate secured to said frame means; and a pair of upwardly extending, substantially parallel roller support plates pivotally connected to said mounting plate for pivotation about an adjustment axis extending parallel to said parallel rotational axes of said rollers;

a shaft extending between said pivotally connected roller support plates, and rotatably supporting the other of said rollers for rotational movement; and means resiliently urging said one roller and said other roller toward each other by pivotation of said support plates and said other roller about said adjustment axis.

9. An apparatus as defined in claim 6 and further characterized as including means for selectively adjusting the position of the weight along said elongated oscillating arm.

10. An apparatus as defined in claim 6 wherein said means rotatably supporting said rollers further includes:

a mounting plate secured to said oscillating motion developing means; and a pair of parallel, fixed drive roller support plates extending normal to said mounting plate and rotatably supporting said driven shaft therebetween and having said one roller positioned therebetween.

11. An apparatus as defined in claim 6 wherein said oscillating motion developing means comprises:

a pair of counterrotating discs mounted for rotation in opposite directions about parallel rotational, substantially horizontal axes; and weights mounted on each of said discs eccentrically with respect to the respective rotational axes thereof and positioned so that when said discs are rotated at the same speed, the eccentrically mounted weights develop cancellative, oppositely acting forces in a horizontal direction, and additive forces in an upward direction and in a downward direction during each rotation of the discs.

12. An apparatus as defined in claim 6 wherein said cable feeding subassembly further includes means for adjusting the pair of feed rollers toward and away from each other to accommodate cables of varying size extended therebetween.

13. An apparatus as defined in claim 6 and further characterized as including:

a mounting plate secured to said frame means; and a pair of upwardly extending, substantially parallel roller support plates pivotally connected to said mounting plate for pivotation about an adjustment axis extending parallel to said parallel rotational axes of said rollers;

a shaft extending between said pivotally connected roller support plates, and rotatably supporting the other of said rollers in said pair for rotational movement; and means resiliently urging said one roller and said other roller toward each other by pivotation of said support plates and said other roller about said adjustment axis.

14. An apparatus as defined in claim 6 and further characterized as including means for selectively adjusting the position of the weight along said elongated oscillating arm.

15. An apparatus as defined in claim 6 wherein said means rotatably supporting said rollers further includes:

a mounting plate connected to said oscillating motion developing means; and a pair of parallel, fixed drive roller support plates extending normal to said mounting plate and rotatably supporting said driven shaft therebetween and having said one roller positioned therebetween.

16. An apparatus as defined in claim 6 and further characterized as including:

a mounting plate connected to said frame means;

a pair of upwardly extending, substantially parallel roller support plates pivotally connected to said mounting plate for pivotation about an axis extending parallel to said parallel rotational axes of said rollers;

a shaft extending between said pivotally connected roller support plates, and rotatably supporting the other of said rollers in said pair of rotational movement; and a second overriding clutch positioned between said last mentioned shaft and said other roller.

17. A cable feeding apparatus for burying a cable, flexible tube or the like in a trench comprising:

a vibrating plow having a plow blade which includes a leading edge and point;

a cable guide mounted behind said plow blade leading edge for guiding a cable or the like downwardly into a trench formed by the plow blade;

oscillating motion developing means connected to said vibrating plow for developing a cyclical, periodic vibratory motion in said plow blade;

an incremental cable feeding subassembly connected to, and responsive to, said oscillating motion developing means for incrementally feeding said cable into said cable guide in response to the vibratory motion of said plow blade, said incremental cable feeding subassembly comprising:

a plurality of feed rollers mounted for rotation about axes spaced around the path of movement of said cable for positioning the peripheries of the feed rollers in engagement with the sides of the cable to advance the cable as at least one of the rollers is positively driven in rotative movement;

means rotatably supporting said rollers for rotation about their respective axes of rotation, said supporting means comprising:

a rotatable driven shaft extending axially through one of said rollers; and means for angularly advancing said one roller when said driven shaft is rotated in one direction of rotation, and for allowing said roller to be disengaged from said driven shaft when said driven shaft is rotated in the opposite direction; and an elongated oscillating arm connected to, and cantilevered from, said driven shaft;

a weight on said oscillating arm, said oscillating arm and said weight being inertially responsive to the vibratory motion developed by said oscillating motion developing means to oscillate from a neutral position to positions on opposite sides of the neutral position, and about the axis of said rotatable driven shaft to cause said driven shaft to rotate periodically incrementally in one direction, and alternately, periodically incrementally in the opposite direction; and means resiliently biasing said oscillating arm toward said neutral centered position; and frame means interconnecting said vibrating plow, said oscillating motion developing means and said incremental cable feeding subassembly.

18. A cable feeding apparatus for burying a cable, flexible tube or the like in a trench comprising:

a vibrating plow having a plow blade which includes a leading edge and point;

a cable guide behind said plow blade leading edge for guiding a cable or the like downwardly into a trench formed by the plow blade;

oscillating motion developing means connected to said vibrating plow for developing a cyclical, periodic vibratory motion in said plow blade;

an incremental cable feeding subassembly connected to, and responsive to, said oscillating motion developing means for incrementally feeding said cable into said cable guide in synchronism with the vibratory motion of said plow, said incremental cable feeding subassembly feeding an increment of cable once each vibratory cycle and comprising:

at least two feed rollers mounted for concurrent rotation with their peripheries spaced to engage sides of the cable to advance the cable as one of the rollers is positively driven in a rotative movement;

means rotatably supporting said rollers for rotation, said supporting means comprising:

a rotatable driven shaft extending axially through one of said rollers; and means for angularly advancing said one roller when said driven shaft is rotated in one direction of rotation, and for allowing said one roller to be disengaged from said driven shaft when said shaft is rotated in the opposite direction; and an elongated oscillating arm connected to said rotatable, driven shaft, said elongated, oscillating arm being inertially responsive to the vibrating motion developed by said oscillating motion developing means to oscillate about the axis of said rotatable driven shaft and an opposite sides of a central axis to cause said rotatable driven shaft to rotate periodically and incrementally in one direction, and then alternately, periodically incrementally in the opposite direction while said one roller follows the rotation of said driven shaft in only one direction of rotation.

19. A cable feeding apparatus as defined in claim 18 wherein said means for angularly advancing one roller when said shaft is rotated in one direction of rotation comprises an overrunning clutch positioned between said shaft and said one roller.

20. A cable feeding apparatus as defined in claim 19 and further characterized as including:

additional shafts extending through and rotatably mounting each of said other rollers; and at least one additional overrunning clutch between one of said additional shafts and one of said other rollers for the purpose of holding the cable in the last position to which it has been incrementally advanced at the time when said driven roller is not being positively driven in rotation.

21. A cable feeding apparatus as defined in claim 18 and further characterized as including a weight mounted on said oscillating arm to enhance the inertia responsiveness of said oscillating arm to the vibrating motion developed by said oscillating motion developing means.

* * * * *

UNITED STATES PATENT AND TRADEMARK OFFICE

CERTIFICATE OF CORRECTION

PATENT NO. : 5,039,252

DATED : August 13, 1991

INVENTOR(S) : Kenneth W. Schuermann

It is certified that error appears in the above-identified patent and that said Letters Patent is hereby corrected as shown below:

In Column 1, line 27, delete "furrowforming" and insert - furrow-forming -.

In the Claims:

In Column 10, line 29, after "vibratory" insert - reciprocating -.

In Column 14, line 58, delete "an" and insert - on -.

Signed and Sealed this

First Day of December, 1992

*Attest:*

*Attesting Officer*

DOUGLAS B. COMER

*Acting Commissioner of Patents and Trademarks*